US009090090B2

(12) United States Patent
Putzer et al.

(10) Patent No.: US 9,090,090 B2
(45) Date of Patent: Jul. 28, 2015

(54) PRINTING APPARATUS FOR PRINTING BOTTLES OR SIMILAR CONTAINERS

(75) Inventors: Frank Putzer, Hamburg (DE); Katrin Preckel, Gelsenkirchen (DE); Manfred Pschichholz, Kamen (DE); Martin Schach, Bochum (DE)

(73) Assignee: KHS GmbH, Dortmund (DE)

( * ) Notice: Subject to any disclaimer, the term of this patent is extended or adjusted under 35 U.S.C. 154(b) by 389 days.

(21) Appl. No.: 13/133,058

(22) PCT Filed: Feb. 19, 2010

(86) PCT No.: PCT/EP2010/001042

§ 371 (c)(1),
(2), (4) Date: Jun. 6, 2011

(87) PCT Pub. No.: WO2010/105726

PCT Pub. Date: Sep. 23, 2010

(65) Prior Publication Data

US 2011/0232514 A1 Sep. 29, 2011

(30) Foreign Application Priority Data

Mar. 19, 2009 (DE) ..... 10 2009 013 477

(51) Int. Cl.

| | |
|---|---|
| ***B41F 17/00*** | (2006.01) |
| ***B41F 17/08*** | (2006.01) |
| ***B41J 3/00*** | (2006.01) |
| ***B41J 3/407*** | (2006.01) |

(52) U.S. Cl.

CPC ..... *B41J 3/4073* (2013.01)

(58) Field of Classification Search

CPC ..... B41F 17/14; B41F 17/16; B41F 17/20; B41F 17/18; B41F 17/28; B41F 17/30; B41J 3/407; B41J 3/4073; B41P 2217/00; B41P 2217/61; B41P 2217/62

USPC ..... 101/35, 38.1, 39, 40, 40.1; 347/4

See application file for complete search history.

(56) References Cited

U.S. PATENT DOCUMENTS

| | | | | | |
|---|---|---|---|---|---|
| 3,478,680 | A * | 11/1969 | Anderson, Jr. | ..... | 101/32 |
| 3,850,096 | A | 11/1974 | Taniguchi | ..... | 101/40 |
| 5,849,321 | A * | 12/1998 | Linnonmaa | ..... | 427/424 |
| 6,627,261 | B1 * | 9/2003 | Vahakuopus et al. | ..... | 427/314 |

(Continued)

FOREIGN PATENT DOCUMENTS

| | | | | | |
|---|---|---|---|---|---|
| DE | 102007036752 | * | 8/2007 | ..... | B41J 3/407 |
| EP | 1225053 | | 7/2002 | ..... | B41J 3/407 |

(Continued)

*Primary Examiner* — Blake A Tankersley
*Assistant Examiner* — Marissa Ferguson Samreth
(74) *Attorney, Agent, or Firm* — Occhiuti & Rohlicek LLP

(57) ABSTRACT

The invention relates to a printing apparatus for printing bottles or similar containers, having several printing positions on a transport element, which can be driven in rotation, by which the printing positions and/or the containers are moved on a closed path of movement between at least one container take-up and at least one container drop, having rotating print heads for applying at least one print image, preferably multi-color, onto a region to be printed on the external container surface of the containers, in the event of relative movement of the external container surface and at least one print head, wherein at least one enclosure is present, into which each of the containers, which are provided at a print position, is housed during the printing process with at least the region to be printed thereof.

19 Claims, 5 Drawing Sheets

(56) References Cited

U.S. PATENT DOCUMENTS

| | | | | |
|---|---|---|---|---|
| 6,769,357 | B1 | 8/2004 | Finan | 101/38.1 |
| 6,923,866 | B2 * | 8/2005 | Hoisington et al. | 118/680 |
| 8,256,854 | B2 * | 9/2012 | Till | 347/2 |
| 2005/0045053 | A1 * | 3/2005 | Finan | 101/38.1 |

FOREIGN PATENT DOCUMENTS

| | | | |
|---|---|---|---|
| EP | 1806233 | 7/2007 | B65B 61/02 |
| GB | 2009675 | 6/1979 | B41F 15/20 |
| WO | 2008/116973 | 10/2008 | B41F 17/28 |
| WO | 2009/018892 | 2/2009 | B41J 3/407 |

* cited by examiner

PRINTING APPARATUS FOR PRINTING BOTTLES OR SIMILAR CONTAINERS

CROSS-REFERENCE TO RELATED APPLICATIONS

This application is the National Stage of International Application No. PCT/EP2009/001042, filed on Feb. 19, 2010, which claims the priority of German Patent Application No. 10 2009 013 477.8, filed on Mar. 19, 2009. The contents of both applications are hereby incorporated by reference in their entirety.

FIELD OF INVENTION

The invention relates to a printing apparatus, and in particular, a printing apparatus for printing on containers using at least one electronically or digitally triggerable print head.

BACKGROUND

Printing, and in particular direct printing, on containers is known. A polychrome print image on a container is often an essential element of the equipping of the container in much the same way that a conventional label is an essential element in labeled containers.

Electrostatic print heads, such as inkjet print heads or print heads known under the designation "Tonejet", i.e. print heads that operate according to the inkjet printing principle or Tonejet principle and that exhibit a plurality of single nozzles disposed sequentially in at least one row on an active print head side in a print head longitudinal axis and which can be individually triggered to dispense ink, printing ink and/or coatings and protective paints, are often used in this regard.

One problem encountered in particular with a printing apparatus for the printing of containers using print heads that operate according to the inkjet printing or Tonejet principle, is that during the printing process, some of the printing ink does not land on that region of the exterior surface of the container that is to be printed upon. It is instead sprayed out into the surrounding air where it forms an aerosol consisting of finely distributed ink or printing ink droplets. These atomized ink droplets then settle undesirably on elements of the printing apparatus. This causes contamination that can only be removed with a considerable amount of cleaning.

Known printing apparatuses are further problematic in that, especially at high rates of production, the containers are moved at high conveying speeds during printing. One consequence of this is that swirling air currents introduce turbulence around the containers. This deflects the printing ink in random ways and impairs image quality.

SUMMARY

The object of the invention is to provide a printing apparatus that avoids the foregoing disadvantages and that ensures high quality printed images without the risk of the printing apparatus being contaminated by printing ink.

In one aspect, the invention features an apparatus configured for managing stray ink that fails to reach a container during printing thereon and for suppressing turbulence that would alter the path of ink droplets as they traverse a gap between a print head and a container to be printed upon during movement of the printing positions. Such an apparatus includes printing positions, and a circumferentially drivable transport element for conveying the plurality of printing positions on a closed path of movement between a container take-up and a container drop. Each of the printing positions comprises a printing a print head and an enclosure. A container carried in the printing position moves with the printing position along the closed path of movement. The print head is configured for applying the image onto a region to be printed upon on an external container surface of a container during relative movement between the external container surface and the print head. The enclosure encloses the region while the container is provided at the printing position. The enclosure prevents ink from the print head from entering the environment and suppresses turbulence in the vicinity of the print head during movement of the printing position along the closed path of movement as the printing operation is carried out.

Some embodiments further include means for extracting atomized ink out of the enclosure. Among these are embodiments that comprise a tube connected to the enclosure through which printing ink is extracted from the enclosure.

In other embodiments, the print head comprises an inkjet print-head.

In yet other embodiments, each printing position comprises a container carrier. The container carrier is controllable to rotate or swivel about an axis to generate relative motion between the container and the print head during printing. Among these are embodiments in which the container carrier comprises a container plate, and the axis is a container plate axis.

Other embodiments include a plurality of enclosures. In these embodiments, each printing position from the plurality of printing positions is assigned an enclosure from the plurality of enclosures. The plurality of printing positions comprises a first printing position and a second printing position. The plurality of enclosures comprises a first enclosure and a second enclosure. The first enclosure is assigned to the first printing position. The second enclosure is assigned to the second printing position.

In some embodiments, at least a part of the enclosure is movably configured to receive and release a container.

Also included are embodiments in which the enclosure comprises cardboard, embodiments in which the enclosure comprises paperboard, and embodiments in which the enclosure comprises plastic.

Additional embodiments include those in which the enclosure has a double wall in at least a region thereof and those in which the enclosure has a perforated wall in at least a region thereof.

In yet other embodiments, the print head is configured to apply a polychrome image.

Among other embodiments are those that include a container carrier provided at each printing position, wherein the print head is controllable to rotate or swivel about an axis to generate relative motion during printing.

In other embodiments, at least a part of the enclosure is movably configured to entrap and liberate a container.

Also among the embodiments are those in which the housing comprises a sleeve that defines a cylinder having an axis. Among these are embodiments in which the sleeve comprises first and second sleeve elements that move relative to each other along the axis of the cylinder to transition between an open cylinder position and a closed cylinder position. These include embodiments that also have a disk disposed such that a normal vector thereof is parallel to the axis, the disk being disposed at an upper end of the sleeve.

As used herein, the terms "ink," "printing ink," or the like are to be understood generally to mean an operating material with which a print image is generated with different quality attributes by using a print head.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE FIGURES

The invention is explained below through the use of embodiment examples with reference to the figures, in which.

DETAILED DESCRIPTION

Figure 1:
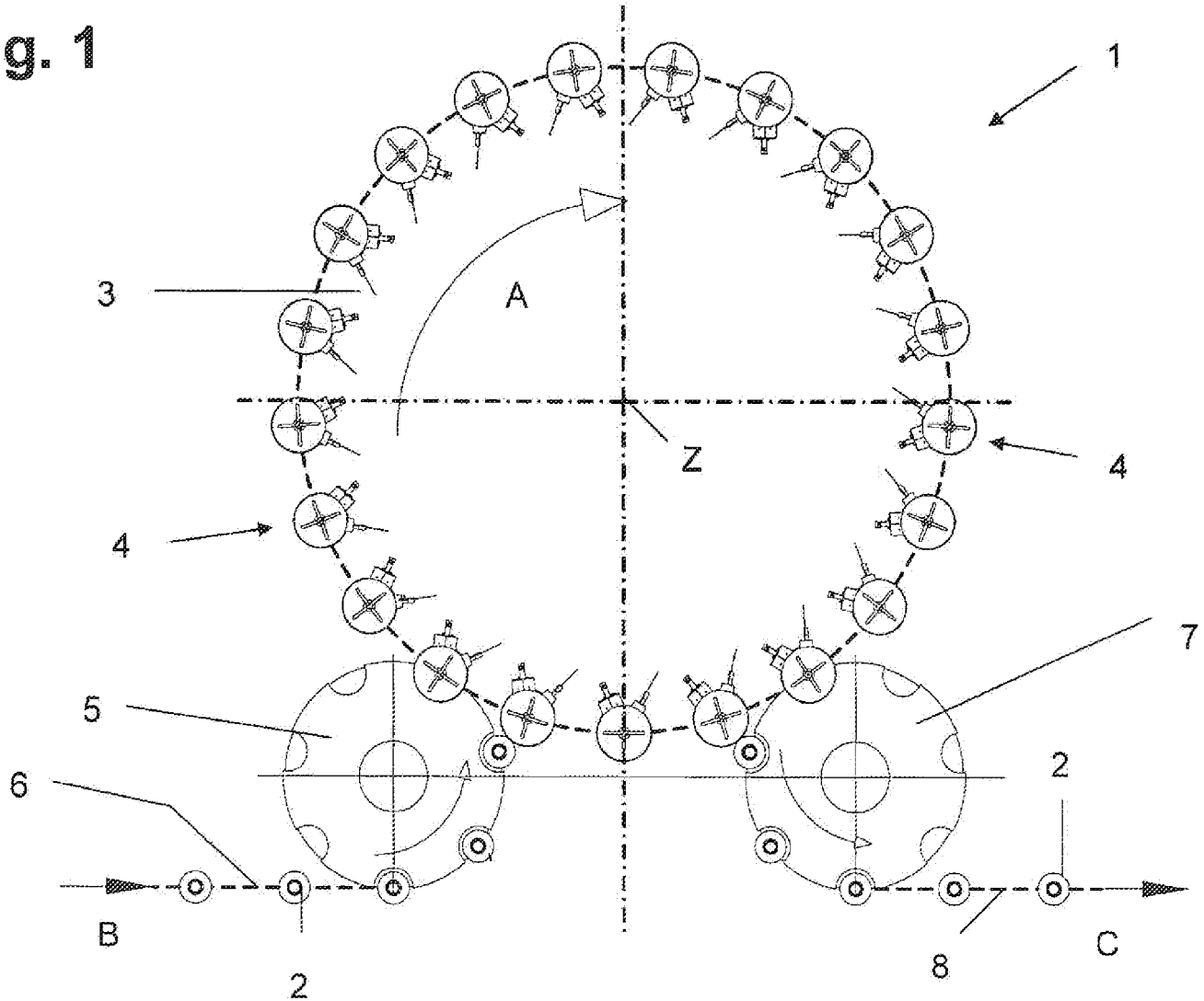
FIG. 1 shows a printing apparatus for the direct printing of containers, for example with print heads that operate according to the inkjet printing principle or Tonejet principle.

A printing apparatus 1 as shown in FIGS. 1-4 is used for the direct printing of containers. In the depicted embodiment, these containers are bottles, specifically PET bottles 2.

The printing apparatus 1 comprises a printing wheel or rotor 3 that can be rotated in the direction arrow A about a vertical machine axis Z. A plurality of handling or printing positions 4 are disposed on the rotor 3 at evenly distributed angular distances about the machine axis Z.

An outer conveyor 6 feeds the bottles 2 to be printed upon to a container intake of the printing apparatus 1. In one embodiment, the container intake is an infeed star 5. As they are being fed, the bottles 2 stand upright, i.e. with their bottle axis vertically oriented, and succeed one another in the transport direction B of the conveyor 6. Each bottle 2 arrives at a printing position 4 via the infeed star 5. At a container discharge, an outlet star 7 takes printed bottles 2 from the printing position 4. An outer conveyor 8 then carries the bottles 2 away in a transport direction C.

Figure 2:
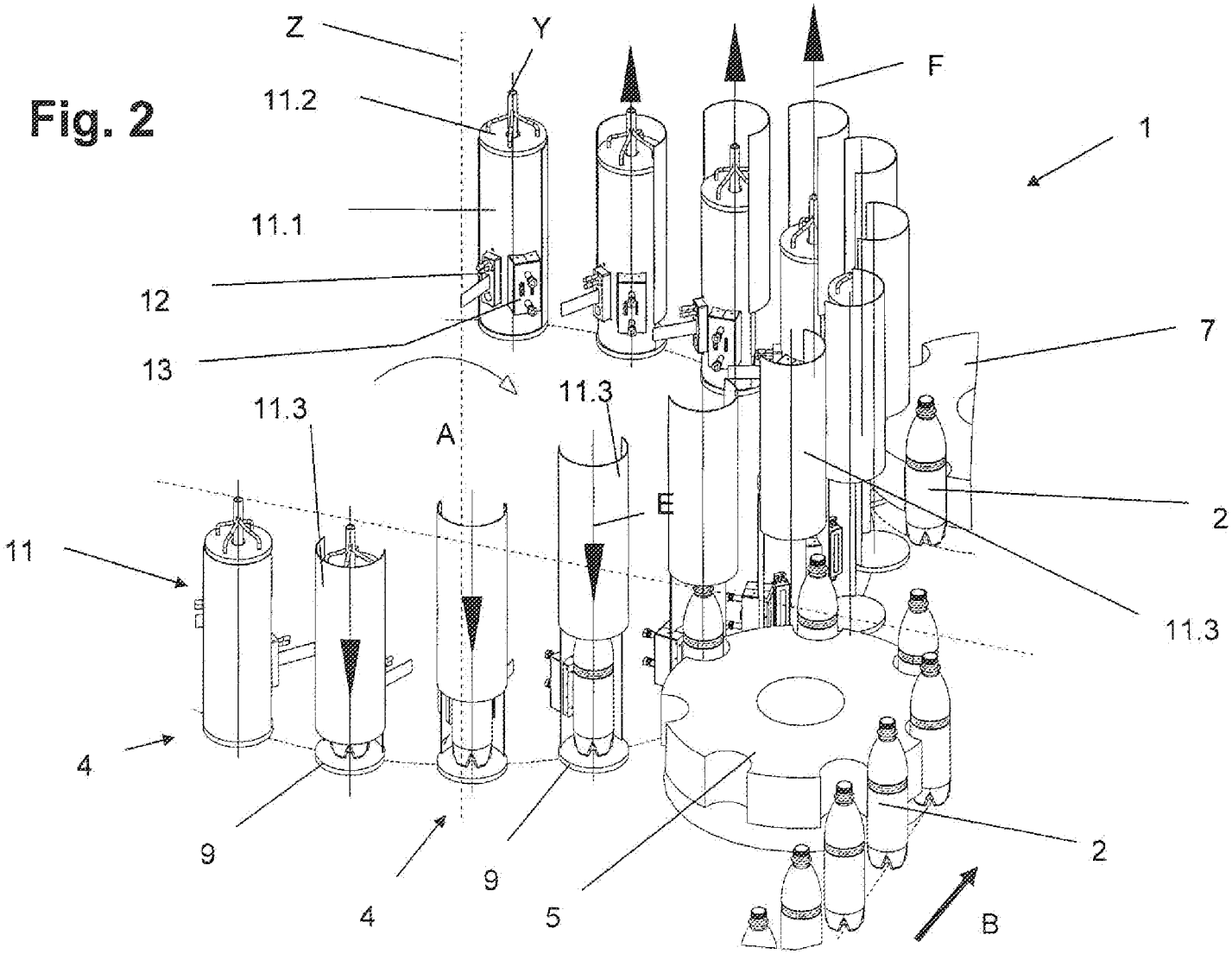
FIG. 2 shows a number of the printing positions disposed around the periphery of a rotor shown in FIG. 1.

Referring to FIG. 2, each printing position 4 comprises a container carrier. In the depicted embodiment, the container carrier includes a container plate 9 that can be controlled to rotate or swivel about a container plate axis Y thereof. The container plate axis Y runs parallel to the machine axis Z (arrow D).

Figure 3:
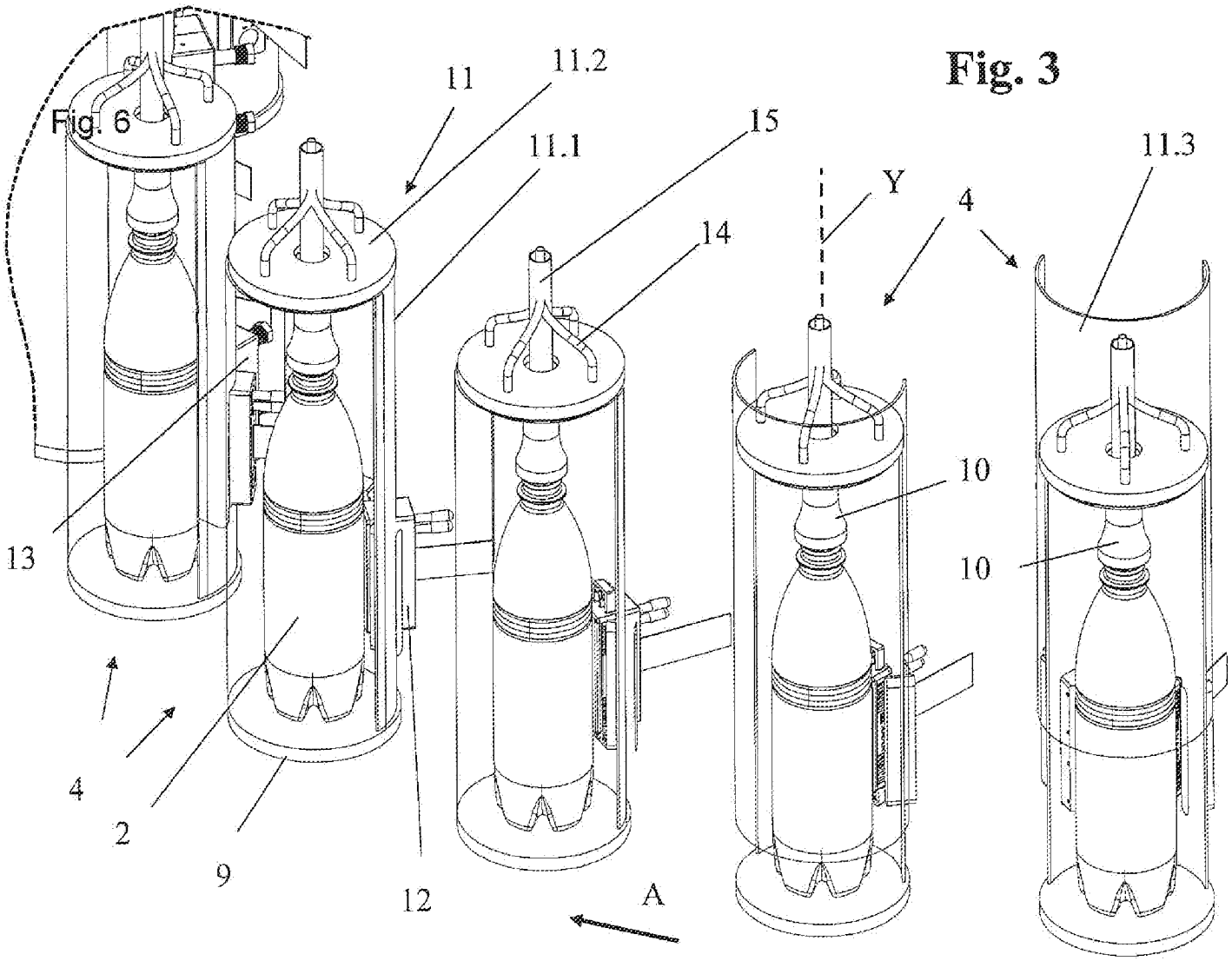
FIG. 3 is an enlarged perspective view of a number of the printing positions disposed around the periphery of the rotor shown in FIG. 1.

Each printing position 4 has a plunger 10, best seen in FIG. 3. The plunger 10 secures the bottle 2 from tipping over after it is transferred to the printing position 4. It does so by clamping the bottle 2 between itself and the container plate 9. Each plunger 10 can be controlled to move down and up on a rotary plate axis Y to secure and to release a bottle 2.

Each of the printing positions 4 also comprises a sleeve-like enclosure or protective sleeve 11. In the illustrated printing apparatus 1, the sleeve 11 has first, second, and third sleeve elements 11.1, 11.2, 11.3.

When closed, the sleeve 11 encloses and houses the bottle 2 provided at the printing position 4. In doing so, the sleeve 11 encloses the entire height of the bottle 2 and leaves clearance between itself and the bottle 2. The first sleeve element 11.1 is rotationally fixed on the rotor 3. As a result, the first sleeve element 11.1 does not rotate with the container plate 9.

The first sleeve element 11.1 defines a portion of a cylinder having a cylinder axis. The cylinder axis is aligned with the container plate axis Y of the associated container plate. In relation to the machine axis Z, the first sleeve element 11.1 is offset radially inwards relative to the associated container plate axis Y. At its upper edge, the first sleeve element 11.1 connects to the second sleeve element 11.2. In the illustrated embodiment, the second sleeve element 11.2 is a circular disc-shaped enclosure element. The second sleeve element 11.2 is part of or connected to the plunger 10 and arranged along the container plate axis Y.

In the illustrated embodiment, the third sleeve element 11.3 comprises an enclosure element. In relation to the machine axis Z, the third sleeve element 11.3 is offset radially outwards relative to container plate axis Y and can be controlled to move up and down in an axial direction E, F parallel to the machine axis Z. In doing so, the third sleeve element 11.3 opens and closes the protective sleeve 11.

Figure 4:
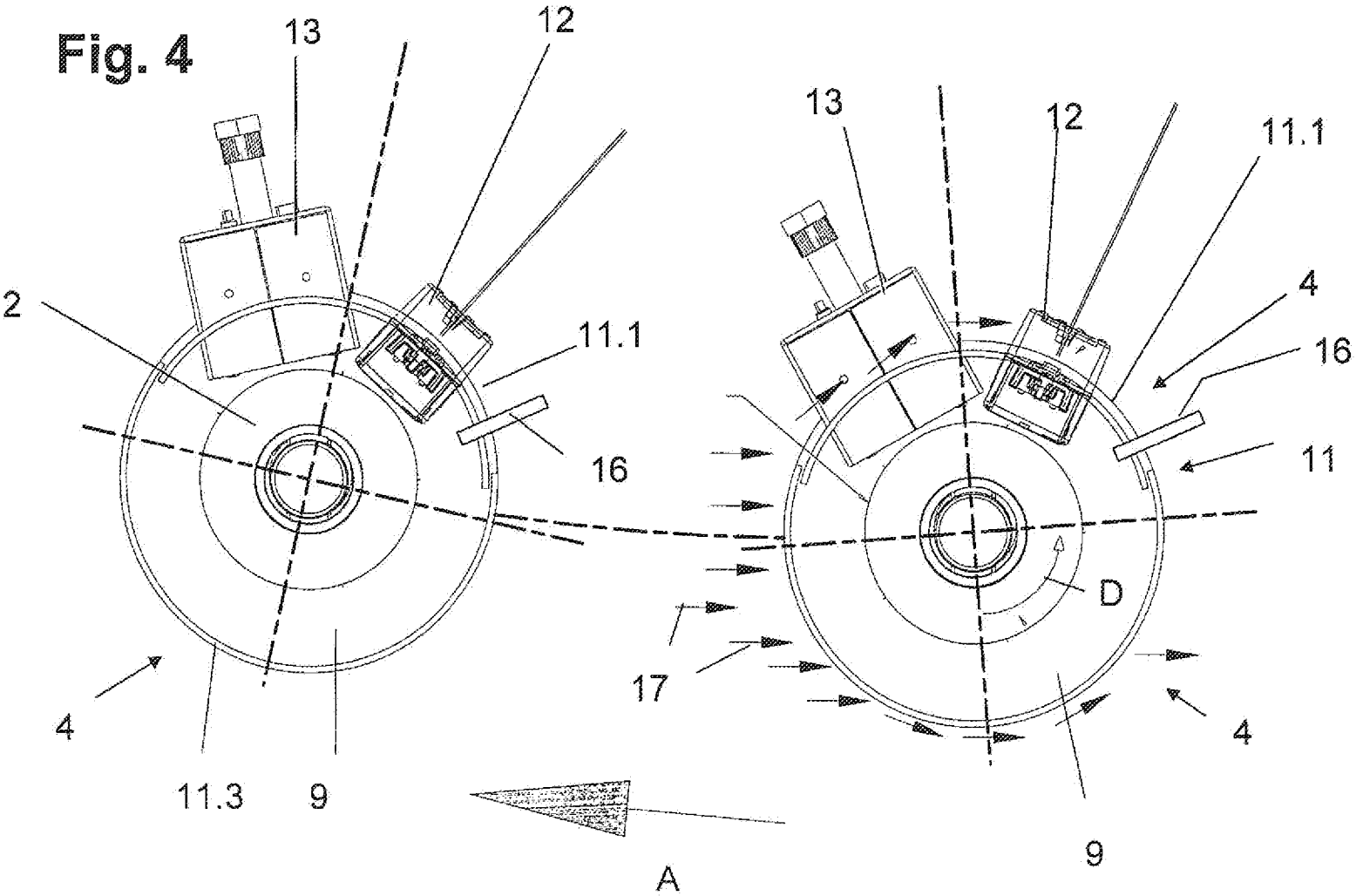
FIG. 4 is an enlarged partial representation and in plan view of two of the printing positions disposed on the periphery of the rotor shown in FIG. 1.

Referring to FIG. 4, a print head 12 and fixing device 13 are provided at each printing position in the first sleeve element 11.1. The fixing device 13 follows the print head 12 in the direction of rotation D of the container plate 9. The print head 12 creates a polychrome print image on a region of the exterior surface of the bottle 2. Rotating the container plate 9 then moves the region to the fixing device 13, which then fixes the printing ink.

The print head 12 consists of multiple individual print heads that can each be digitally or electronically triggered and that operate, for example, according to the Tonejet principle or Tonejet method. Each individual print head has a plurality of nozzle orifices to dispense the printing ink. The nozzle orifices are disposed in at least one row that is parallel or essentially parallel to the container plate axis Y. Each nozzle orifice can be independently triggered to discharge ink. The print head 12 is disposed such that the print direction of the print head 12, i.e. the direction in which the ink is dispensed from the print head 12 or from the individual nozzle orifices, is oriented radially or essentially radially to the machine axis Z. As a result of this orientation, centrifugal force generated by the rotating rotor 3 assists in discharging printing ink onto the bottle 2.

The individual print heads contain printing inks of different colors, for example red, blue, yellow and black. These are used to generate the different color separations. The print image is generated by triggering the print head 12 or the individual print heads and controlling the rotation of the bottle 2 about the container plate axis Y, and hence about the bottle's axis. Control over triggering and rotation is based on artwork stored electronically in a computer.

Printing on bottles 2 is carried out in such a way that each bottle 2 is transferred to a printing position 4 with the protective sleeve 11 of that printing position 4 open, i.e. with the third sleeve element 11.3 raised. At the same time as this transfer, while the bottle 2 is still held in the infeed star 5, the plunger 10 lowers to secure the bottle 2 against tipping over. The bottle 2 is centered such that its bottle axis is coaxial with the container plate axis Y of the container plate 9.

On a first angular range of the rotary motion of the rotor 3, the protective sleeve 11 is closed by controlled lowering of the third sleeve element 11.3. On a further angular range of the rotary motion of the rotor 3, the printing of the respective bottle 2 is carried out with the protective sleeve 11 closed.

In some embodiments, printing is carried out by having the bottle 2 undergo one complete revolution about its bottle axis for each color set of the print image. During each revolution, a printing head 12 assigned to that color set prints that color set on the bottle 2 and the fixing device 13 fixes it.

The fixing device 13 carries out the fixing by, for example, drying the ink using an energy input, such as thermal energy, e.g. hot air or infrared radiation, UV radiation, microwave energy, etc.

Subsequently during a further revolution of the bottle 2 about its bottle axis, the next color set is applied with whatever print head 12 is assigned to that color. The ink is again fixed by the fixing device 13. This procedure continues until all color sets have been printed.

Other methods of applying the individual color sets of the polychrome print image are also possible. For example, in some embodiments, the polychrome print image is generated in a single pass with one print head 12 or with multiple print heads oriented on the container periphery. This procedure is called "wet on wet printing." The inks are then fixed at the fixing device 13.

Regardless of what printing method is used, some of the printing ink does not make it to the bottle 2. Instead, it forms an ink aerosol that surrounds the bottle 2. This ink aerosol contains atomized printing ink that can contaminate the printing apparatus 1. To avoid contamination by this ink aerosol, the printing of each bottle 2 is carried out with the protective sleeve 11 closed.

An extraction system extracts the ink aerosol from the enclosure. In the embodiment shown in FIG. 3, the extraction system comprises a plurality of extractor tubes 14. These extractor tubes 14 open out into the interior of the protective sleeve 11 at the second sleeve element 11.2. The extractor tubes 14 are each connected via collector tubes or pipes 15 to an extraction unit that is common to all print positions 4. To facilitate the extraction of the atomized printing ink, each protective sleeve 11 is configured in such a way that, at the lower edge of the closed protective sleeve 11, a slit-like opening remains for a flow of supply air into the interior of the protective sleeve 11.

Extracting the ink aerosol from the interior of the protective sleeve 11 also prevents printing ink droplets from settling uncontrollably on the exterior surface of the bottle 2, thus avoiding potential impairment of the bottle's appearance and overall commercial impression.

In order to reduce the amount of atomized printing ink and to enhance the quality and/or sharpness of the print image, there is provided, on the inside of each protective first sleeve element 11.1, at least one rod-shaped electrode 16 upstream of the print head 12 in the direction of rotation D of the container plate 9. The electrode 16 is connected to a high DC voltage, for example a DC voltage of up to 30 kV. The high voltage is applied at least before and during the printing process. This high voltage promotes static charge of the bottle 2 at the region to be printed upon. As a result, if the print head 12 has an opposite voltage, an electrostatic field accelerates the ink droplets towards the bottle, and specifically towards the print region of the bottle. Moreover the voltage at the electrode 16 generates a cloud of ions. These ions capture the ink droplets and take them away.

The act of enclosing the bottles 2 in the protective sleeves 11 during printing has advantages beyond merely preventing the printing apparatus 1 being contaminated by atomized printing ink. Air turbulence around the bottles 2 impairs the quality of the print image. The enclosure avoids this problem.

The problem of air turbulence is particularly important given that the rotor 3 rotates at high speed about the machine axis Z, especially when the printing apparatus 1 is operated at high output so that a large number of bottles 2 are processed per unit of time. At each printing position 4, this motion results in considerable air flow 17, as shown in FIG. 4. The closed protective sleeve 11 protects the bottles 2 and/or the printed regions against this air flow 17 during printing. This in turn prevents discharged ink droplets from being deflected from their flight path by moving air. This enables achievement of the desired droplet placement, thus improving the quality of the required mage. The ratio of droplet velocity to printing speed as specified by the print head manufacturer is therefore not adversely affected by externally acting air flow 17.

In the embodiments described thus far, upon the transfer of a bottle 2 from the infeed star 5 to a printing position or upon the removal of the printed bottle 2 from a printing position 4 at the outlet star 7, with the protective sleeve 11 being open in each case, the plunger 10 is lowered and raised. However, only relative motion is needed. Thus, for non-movable plungers 10, it is also possible for the bottles 2 to be raised and pressed up against the plunger 10 at the infeed star 5, and lowered down from the plunger 10 at the outlet star 7.

In the embodiments described thus far, the third sleeve element 11.3 is lowered and raised under control to open and close the protective sleeve 11. Other embodiments lower the third sleeve element 11.3 to open the protective sleeve 11 and to raise it to close the protective sleeve 11, and/or to provide it pivotably for opening and closing the protective sleeve 11. Yet other embodiments lower and raise the protective sleeve 11 altogether to enclose the bottle 2 for printing and to release the bottle 2 after printing.

Figure 5:
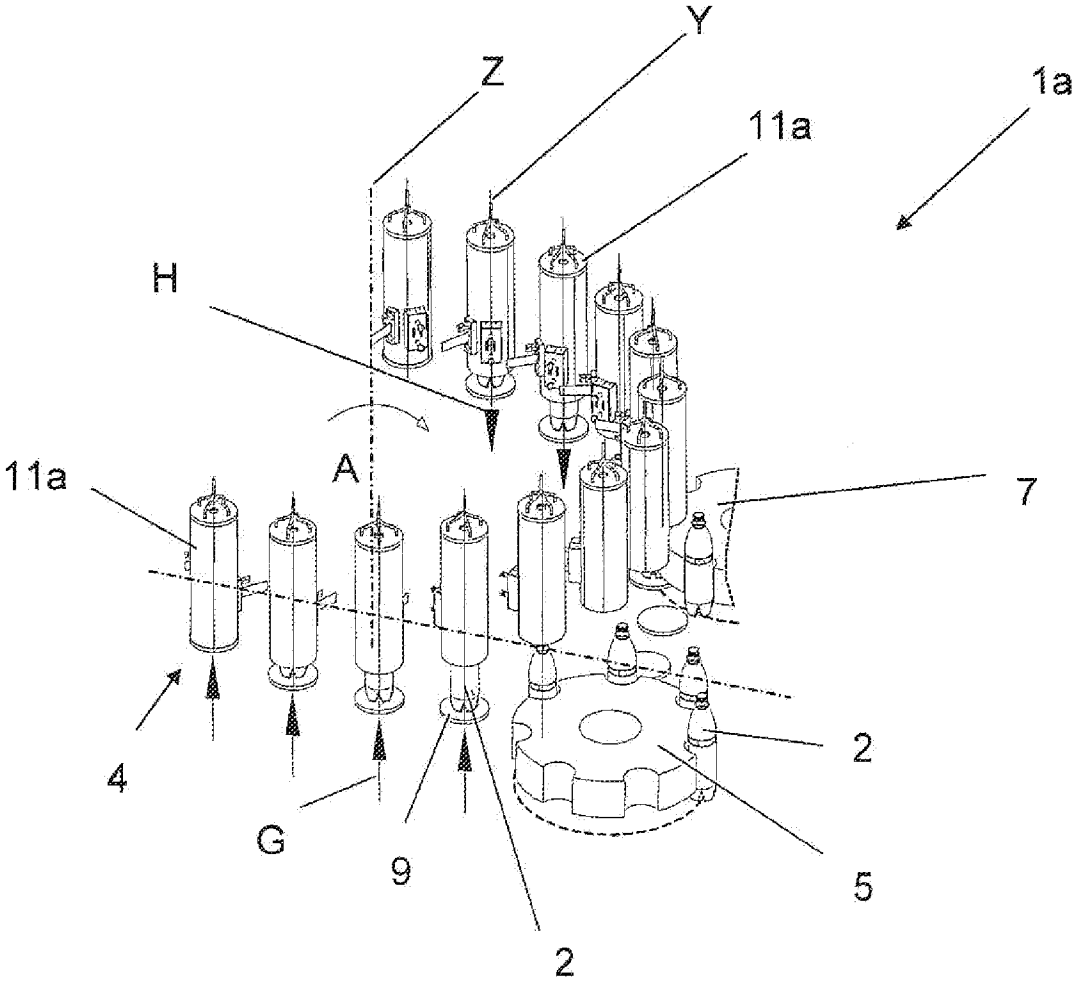
FIG. 5 is a representation similar to FIG. 2 of a further embodiment of the invention.

In a depiction that is similar to FIG. 2, FIG. 5 shows a printing apparatus 1*a* that differs from printing apparatus 1 by having a closed protective sleeve 11*a* configured as a hollow cylinder with a hollow-cylinder-shaped interior and exterior surface being provided for each enclosure during printing. At the container intake or infeed star 5, each bottle 2 transferred to a container plate 9 is introduced into the protective sleeve 11*a* from below through the controlled raising of the container plate 9. At the container discharge or outlet star 7, each printed bottle 2 is lowered down out of the protective sleeve 11*a* through the controlled lowering of the associated container plate 9 so that it can be accepted by the outlet star 7 and transferred on to the outer conveyor 8.

The protective sleeve 11, and in particular its first and third sleeve elements 11.1 and 11.3 as well as the protective sleeve 11*a*, are made, for example, from plastic or from cardboard or paperboard. As such, they are disposable elements that can be replaced by fresh sleeve elements 11, 11*a* when heavily contaminated by atomized or splashed printing ink.

In the embodiments described thus far, a gap is formed at the lower edge of the protective sleeve 11, 11*a* through which supply air can flow into the protective sleeve interior when the atomized or splashed printing ink is extracted. Other openings for the supply air can also be provided in addition to or instead of this gap. In particular, openings in the side wall or in the jacket of the protective sleeve 11, 11*a* can be provided. In another embodiment, the protective sleeves 11, 11*a* have double walls at least in partial regions. In yet other embodiments, they have a multiply perforated wall on the inside such that the supply air that is required for extraction no longer flows into the protective sleeve interior through a gap at the lower edge of the particular sleeve 11, 11*a*. Instead, it flows through the space between the outer and the inner wall element and the openings provided in the inner wall element.

The invention has been described by reference to selected embodiments. Numerous variations as well as modifications are possible without departing from the inventive concept underlying the invention.

Having described the invention, and a preferred embodiment thereof, what is claimed as new and secured by Letters Patent is:

1. An apparatus comprising a plurality of printing units, wherein said apparatus is configured for managing stray ink that fails to reach a container during printing thereon and for suppressing turbulence that would alter the path of ink droplets as they traverse a gap between a print head and a container to be printed upon during movement of said plurality of printing units, said apparatus comprising at least the plurality of printing units, and a circumferentially drivable transport element for conveying said plurality of printing units on a closed path of movement between a container take-up and a container drop, wherein each printing unit from said plurality of printing units comprises a print head and an enclosure, wherein a container carried in said printing unit moves with said printing unit along said closed path of movement, wherein said print head is configured for applying an image onto a region to be printed upon on an external container surface of a container during relative movement between said external container surface and said print head, wherein said enclosure encloses said region while said container is provided at said printing unit, whereby said enclosure prevents ink from said print head from entering the environment, and wherein said enclosure suppresses turbulence in the vicinity of said print head during movement of said printing unit along said closed path of movement during the printing operation.

2. The apparatus of claim 1, further comprising means for extracting atomized ink out of the enclosure.

3. The apparatus of claim 2, further comprising a tube connected to said enclosure through which printing ink is extracted from said enclosure.

4. The apparatus of claim 1, wherein the print head comprises an inkjet printhead.

5. The apparatus of claim 1, wherein each printing unit comprises a container carrier wherein the container carrier is controllable to rotate or swivel about an axis to generate relative motion between said container and said print head during printing.

6. The apparatus of claim 5, wherein said container carrier comprises a container plate, and said axis is a container plate axis.

7. The apparatus of claim 1, further comprising a plurality of enclosures, wherein each printing unit from said plurality of printing units is assigned an enclosure from said plurality of enclosures, wherein said plurality of printing units comprises a first printing unit and a second printing unit, wherein said plurality of enclosures comprises a first enclosure and a second enclosure, wherein said first enclosure is assigned to said first printing unit, and wherein said second enclosure is assigned to said second printing unit.

8. The apparatus of claim 1, wherein at least a part of said enclosure is movably configured to receive and release a container.

9. The apparatus of claim 1, wherein the enclosure comprises cardboard.

10. The apparatus of claim 1, wherein the enclosure has a double wall in at least a region thereof.

11. The apparatus of claim 1, wherein said print head is configured to apply a polychrome image.

12. The apparatus of claim 1, further comprising means for extracting printing ink from said enclosure.

13. The apparatus of claim 1, further comprising a container carrier provided at each printing position, wherein said print head is controllable to rotate or swivel about an axis to generate relative motion during printing.

14. The apparatus of claim 1, wherein at least a part of said enclosure is movably configured to entrap and liberate a container.

15. The apparatus of claim 1, wherein said housing comprises a sleeve that defines a cylinder having an axis.

16. The apparatus of claim 15, wherein said sleeve comprises first and second sleeve elements that move relative to each other along said axis of said cylinder to transition between an open cylinder position and a closed cylinder position.

17. The apparatus of claim 16, wherein said sleeve comprises a disk disposed such that a normal vector thereof is parallel to said axis, said disk being disposed at an upper end of said sleeve.

18. The apparatus of claim 1, wherein said enclosure comprises paperboard.

19. The apparatus of claim 1, wherein said enclosure comprises plastic.

* * * * *